US008910654B2

(12) United States Patent
Dawes

(10) Patent No.: US 8,910,654 B2
(45) Date of Patent: Dec. 16, 2014

(54) WASHER DRAIN SYSTEM AND METHOD

(76) Inventor: R. Kevin Dawes, West Covina, CA (US)

( * ) Notice: Subject to any disclaimer, the term of this patent is extended or adjusted under 35 U.S.C. 154(b) by 412 days.

(21) Appl. No.: 13/405,261

(22) Filed: Feb. 25, 2012

(65) Prior Publication Data

US 2013/0220449 A1 Aug. 29, 2013

(51) Int. Cl.
*D06F 39/08* (2006.01)

(52) U.S. Cl.
USPC ..... 137/387; 137/360; 137/400; 137/558; 68/208; 307/118; 340/616; 340/624; 361/178

(58) Field of Classification Search
USPC ..... 137/386, 558, 387, 400, 597, 360; 68/12.05, 12.02, 12.16, 208; 307/118; 361/178; 340/616, 623, 624
See application file for complete search history.

(56) References Cited

U.S. PATENT DOCUMENTS 3,091,111 A * 5/1963 Cruse et al. ..... 68/208
3,862,433 A * 1/1975 Rousselet ..... 307/118
3,867,957 A * 2/1975 Fehrm ..... 137/360
3,874,403 A * 4/1975 Fischer ..... 137/386
4,069,837 A * 1/1978 Jirasek ..... 137/360
4,380,243 A * 4/1983 Braley ..... 137/312
4,418,712 A * 12/1983 Braley ..... 137/312
4,637,422 A 1/1987 Izzi
5,028,910 A * 7/1991 Meacham et al. ..... 340/616
5,125,247 A * 6/1992 Mills ..... 137/312
6,003,536 A * 12/1999 Polverari et al. ..... 137/15.08
6,998,990 B2 * 2/2006 Johnson ..... 68/208
7,290,557 B1 11/2007 Bowman

* cited by examiner

*Primary Examiner* — Craig Schneider
(74) *Attorney, Agent, or Firm* — Lewis Brisbois Bisgaard & Smith LLP; Jon Hokanson

(57) ABSTRACT

A system for preventing flooding caused by blockages in the drain lines of appliances such as washing machines, dishwashers and the like included a sealed connection between a washing machine drain line and the sewer line drain, further including a washing machine drain line inlet attachment to a housing, the inlet line connecting to the sewer drain line and to a sealed vent pipe connected to the sewer line drain above the inlet attachment, and including a C-shaped loop in fluid communication with the sewer drain line and containing a float actuated control valve adapted to cut off power to the washing machine upon actuation; a kit containing components of the system and methods of installing the system and kit.

8 Claims, 4 Drawing Sheets

PROJECT

REVISIONS

SHEET TITLE

PROJ. NO.

AGENCY NO.

DATE 2-8-11

DRAWN BY S.K.N.

AGENCY APPROVAL

SHEET NO.

PROJECT

REVISIONS

SHEET TITLE

PROJ. NO.

AGENCY NO.

DATE 2-8-11

DRAWN BY S.K.N.

AGENCY APPROVAL

SHEET NO.

PROJECT

REVISIONS

SHEET TITLE

PROJ. NO.

AGENCY NO.

DATE 2-8-11

DRAWN BY S.K.N.

AGENCY APPROVAL

SHEET NO.

PROJECT

REVISIONS

SHEET TITLE

PROJ. NO.

AGENCY NO.

DATE 2-8-11

DRAWN BY S.K.N.

AGENCY APPROVAL

SHEET NO.

WASHER DRAIN SYSTEM AND METHOD

FIELD OF INVENTION

The invention relates generally to systems and methods to prevent washing machine flooding that commonly occurs due to flaws in the present method of connecting a washing machine drain hose to a sewer line drain, and methods of installing such systems. More particularly, the systems relate to electro-mechanical devices that function to create a sealed connection between the washing machine drain hose and sewer line drain. These devices include sensors capable of detecting blockage in the sewer line drain as well as systems and methods to shut-off the washing machine and cease the pumping of waste water to prevent flooding in the event that blockage in the sewer line drain is detected.

BACKGROUND

The present method of connecting a washing machine drain hose to a sewer line drain is flawed and results in a tremendous amount of property damage, globally every year, due to flooding. Water damage resulting from washing machine flooding is believed to be a costly form of recurring property damage.

Conventional methods of connecting a washing machine drain hose to a sewer line drain are flawed because the connection between the washing machine discharge and the sewer is not sealed and is therefore susceptible to flooding. In the current method, the washing machine pumps and discharges waste water through a smaller flexible drain hose that is loosely inserted into a larger open sewer line drain. This conventional connection is not sealed in order to provide an "air-gap", or "vacuum break", that is needed to prevent induced siphonage during the wash cycle. Without an "air-gap", or "vacuum break", the resulting induced siphonage would prematurely empty the washing machine, obviously defeating the function of the washing machine. The present system provides for a solution by incorporating both a sealed connection between the washing machine drain hose and the sewer line drain and a "vacuum break" that prevents induced siphonage. Prior to the present system a system and method that provides both a sealed connection and a "vacuum break" has not been introduced.

One main problem with the current method of connecting a washing machine drain hose to a sewer line drain is that the smaller flexible drain hose, which pumps water out of the washing machine, will sometimes drop-out of the larger open sewer line drain pipe. If the smaller drain hose drops-out of the larger open sewer line drain and is not noticed and rectified immediately, the washing machine will continue through its wash, rinse, and drain cycle thereby pumping a significant amount waste water onto the floor, causing severe flood damage.

The current method is also inherently flawed because it incorporates an open sewer line drain with direct exposure to the living area or other area where the washing machine discharges into the sewer line. Even if the washing machine drain hose does not drop-out of the larger open sewer line drain, this area remains susceptible to severe flood damage in the event that the sewer line is blocked. If a blockage occurs in the in-ground or the under-floor 2" or 3" drain pipe, or in the inline sewer drain, then, as the washing machine washes and drains, the pumped waste water can only escape through the open end of the larger sewer line drain pipe or "vacuum break". This situation will result in major flooding possibly mixed with foul water. The preferred present system includes sensors to detect blockage, a sub-system to shut-off the washing machine and cease the pumping of waste water to prevent flooding in the event that blockage in the sewer line drain is detected, surge protection and an alarm.

An additional problem with the open sewer line drain is that it is possible for the water seal in the drain trap to evaporate, thus allowing direct access of foul sewer gases and vermin into the living area. The preferred present system also addresses this problem.

SUMMARY

The present system overcomes the drawbacks of conventional washing machine installations by preventing severe water damage from flooding as well as preventing foul sewer gases and vermin intrusion through the large open sewer line drain through a sealed connection between the washing machine drain hose and the sewer line drain. The system may also be used for other appliances or devices, such as dishwashers, that use water for some purpose and then must discharge the used water to a sewer.

The present system incorporates a sealed connection without inducing siphonage because a sealed vent extends from the sewer line drain above the washing machine drain input connection. The functionality resulting from the structures of the present system that connect a sewer vent pipe above a sealed drain connection is a breakthrough in plumbing technology because it solves the problems caused by induced siphonage and thereby enables the sealed connection without disrupting the functionality of the washing machine.

The present system also includes sensors to detect blockage and an electro-mechanical sub-system that functions to shut-off the washing machine and stop pumping of waste water to thereby prevent flooding in the event of blockage in the sewer line drain.

In order to protect against flooding that could result from blockage of the sewer line and a backup of water from a source other than the washing machine, the system also incorporates a one-way check valve in order to prevent the ingress of foul water into a washing machine. This occurs when rising water, due to a sewer line blockage, reaches the invert level of the washing machine drain outlet.

The present system and method provide structures for preventing flooding due to blockage in the drain line of appliances such as washing machines, dishwashers and the like. The system may also be provided in a kit form for easy and efficient installation in new construction or in remodeling applications.

In one embodiment and in a simplified form, the system includes a solid connection of an appliance drain line to a horizontally oriented inlet to a T-connection of a pipe, with one leg or bar of the T lying substantially horizontal to the earth's surface at a first height, and the cross bar pipe of the T oriented vertically. Preferably a flow control device is positioned in the system at some point between the outlet of the appliance and the vertical cross bar pipe. Most preferably the flow control device is a one-way check valve positioned at or near the connection of the appliance drain pipe and the T-connection, and oriented to permit flow of water from the appliance, e.g., the washing machine to the T-connection and to prevent backflow of water from the T-connection to the washing machine One leg of the cross bar pipe extends vertically upward from the connection above the first height and is connected to a vent that in turn is in fluid communication to atmosphere to provide a venting function for the system. The other or second leg of the cross bar pipe extends downward from the connection below the first height and is connected to a sewer and a lower, second height.

Positioned at a height intermediate the first and second heights in the vertically oriented inlet of the T-pipe is a flow blockage sensor, alarm and control sub-system that functions to sense when a blockage occurs in the drain system, to provide audible and/or visual alarms when such a blockage is detected and/or to control the appliance by cutting off power to the appliance to prevent contaminated water from back flowing into the washing machine. By cutting off power to the appliance as soon as a blockage is detected, flooding can be prevented or minimized. This sub-system preferably includes a flow loop in fluid communication with the lower leg of the T-connection, a conventional float actuated switch positioned in the loop, conventional audible and/or visual alarms or indicators operatively connected to the switch, and a circuit operative to cut off power to the washing machine, or other appliance, when a blockage is detected. During operation of a washing machine drain cycle and the present system, and in the event of a blockage in the drain line downstream of the T-connection, draining water will begin to rise in the drain. The water will continue to rise to some height above the second, sewer connection height, and at some point will reach the lower leg of the flow loop, positioned at a third height that is intermediate the first and second heights. The water will then continue to rise and at some point will cause the float of the float actuated switch to rise. The float is positioned in the loop and it will rise with the rising water until it contacts the switch and the float activated switch then causes the alarm(s) to activate and the power to the washing machine to be cut off, thereby stopping the flow of water from the washing machine. The one-way flow check valve operates to prevent any water from back flowing into the washing machine in the event the water level rises to the first height or above.

In another preferred embodiment a connector between the washing machine discharge hose and the T-connection is provided. Preferably, this connector includes a first end with a connection adapted to connect to and provide a tight, closed connection to the T-connection, a second end with a connection adapted to connect to the distal end of a washing machine discharge or drain line, and positioned intermediate the two ends a plurality of connected, telescoping pipe sections of differing diameters that are adapted for connection with washing machine discharge lines of different diameters. In this embodiment a plurality of washing machine discharge or drain line liners are provided to accommodate drain lines of a various diameters.

In another preferred embodiment the above-described system is provided in a kit form, ready to be installed in a new construction or remodel context. In a kit form the T-connection and flow blockage control sub-system are provided in housing or washing machine box that is adapted for easy installation in the building's framework, most preferably in a studded wall. Variations of the kits include, in addition, hot and cold water service connections and valves, alarm indicators, control switches, and inlet and outlet orifices and/or connections for the connection to the washing machine drain line, vent line and sewer drain line. The housing or box may also be provided with brackets, straps, extensions or other members adapted for easy positioning and attachment to the building's frame or wall. In the kit embodiments, the universal washing machine drain connection may be included, or provided separately.

Depending on which system embodiment is used, various methods may be used for installation of the system, system components and the kit(s).

These and other embodiments, features, aspects, and advantages of the invention will become better understood with regard to the following description, appended claims, and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein:

FIG. 2 End Elevation is an elevation view of the FIG. 1 embodiment, taken at 90° from the FIG. 2 Front Elevation view;

FIG. 4 Electrical Surge Protection is circuit diagram of the surge protection sub-system of the FIG. 1 embodiment; and, FIG. 4 Alarm view is a front view of the alarm indicator panel of the 1 embodiment.

Reference symbols or names are used in the figures to indicate certain components, aspects, and/or features shown therein. Reference symbols common to more than one figure indicate like components, aspects and/or features shown therein.

DETAILED DESCRIPTION

In accordance with embodiments described herein, the present system prevents major flood damage by providing a sealed connection between the washing machine drain hose and the sewer line drain without inducing siphonage. Preferred embodiments of the present system also include sensors to detect drain line blockage, a sub-system that functions to shut-off the washing machine and stop pumping of waste water in order to prevent flooding, a surge protection sub-system and an alarm sub-system.

Figure 1:
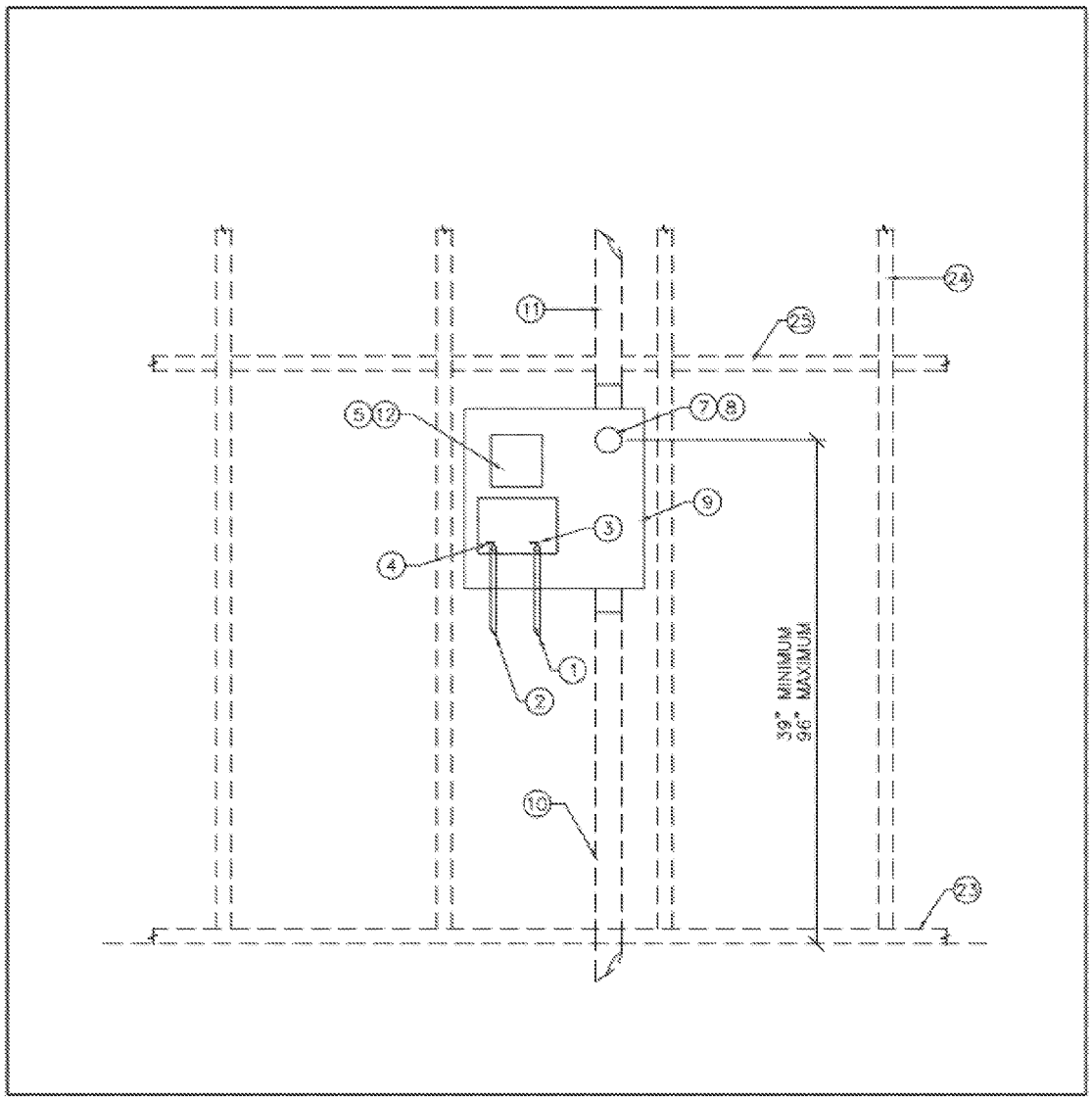
FIG. 1 is a schematic diagram illustrating a preferred embodiment in a typical environment of use.

Referring to FIG. 1 a preferred system includes a self-contained, easy-plumbed housing or body chassis 9, preferably of neat appearance, with finish trim to cover the joint between the box and surrounding drywall, not shown. The housing or chassis 9 includes water supply valving, a back-flow prevention sub-system, generally and preferably shown inside of a conventional J-box/sensor at 12 and a washing machine drain line inlet, shown as a universal drain attachment at 7. The water supply includes cold water piping inlet 1, hot water piping inlet 2, cold water shut off valve and connection 3, and hot water shut off valve and connection 4. Main sewer pipe 10 is shown connected to the chassis 9 and connected to a sewer line, not shown. Sewer vent pipe 11 is shown connected to the chassis 9 and leading to the atmosphere.

Figure 4:
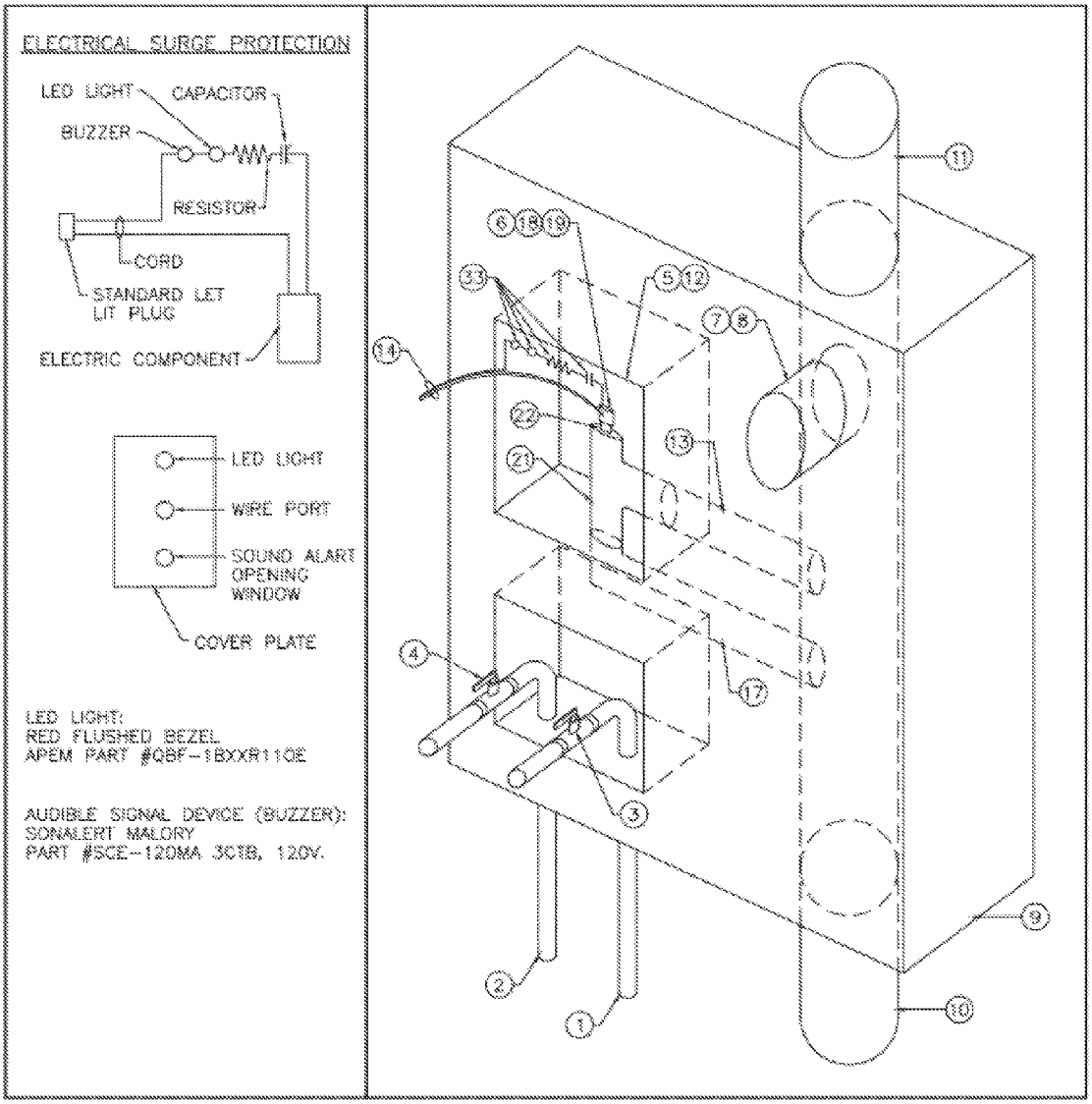
FIG. 4 Perspective is a perspective view, showing some internal components dashed lines, of the FIG. 1 embodiment.

In FIGS. 1 and 4 Perspective, the body chassis 9 is shown in a typical installation within a studded wall, having vertically extending studs, one of which is shown at 24, and with horizontal cross members, one of which is shown as ceiling top plate 25. The chassis 9 is preferably made of a plastic material, and is typically mounted above floor base plate 23 preferably at a height between a minimum of 39 inches and a maximum of 96 inches. The washing machine may rest on the floor base plate 23 or on a raised floor, such as tiles.

Figure 2:
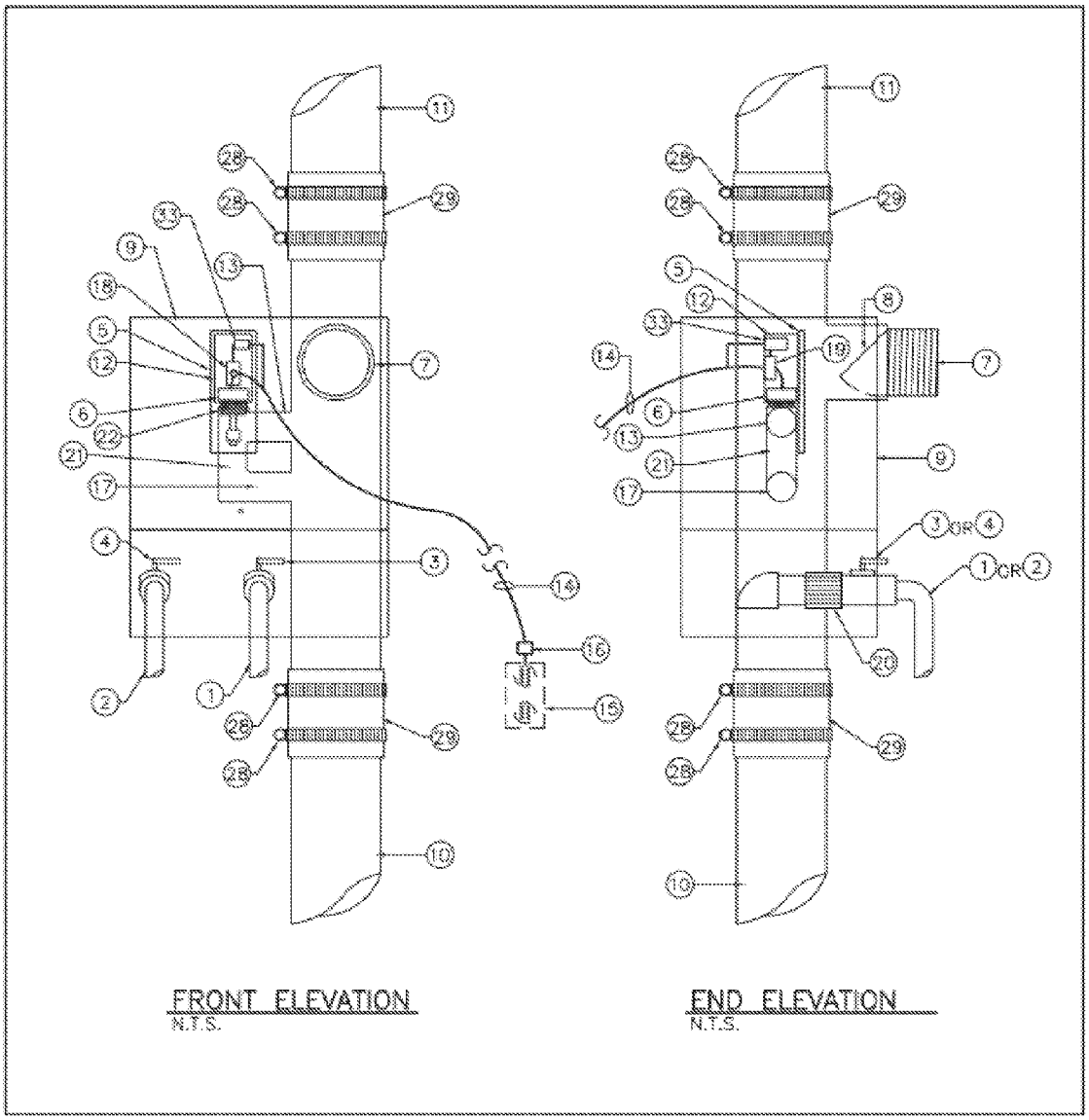
FIG. 2 Front Elevation is a front elevation view of the FIG. 1 embodiment.

Referring to FIGS. 2 Front Elevation and 2 End Elevation, preferred system structures and operation of the system components inside of the chassis 9 will be described. Inside the chassis is a sub-system of pipe work, preferably using pipes having diameters of 2, 3 or 4 inches. An illustrative pipe, not numbered, that may be made of conventional copper, PVC, etc., construction extends vertically inside of the box from bottom to top, and preferably with a right angle, or T-connection at the universal drain connection 7 to the washing machine drain line. The top of the pipe is for connection to sewer vent pipe 11 and the bottom of the pipe is for connection to the main sewer pipe 10. The system t-pipe is connected to the vent and sewer pipes with conventional no-hub connectors 28 and universal washing machine drain hose adapters, available in various sizes, and as shown.

Also referring to FIGS. 2 Front Elevation and 2 End Elevation a back flow sensing and shut-off sub-system will be described. Positioned within the chassis 9 and on the T-pipe is a horizontally extending lower leg or T-junction, a water overflow pipe 17. The pipe 11 connects to a vertically extending over flow pipe by pass 21. The pipe by pass 21 then connects to a horizontally extending pipe 13, referred to as a vent connection of the overflow pipe back to the main sewer pipe 13. In combination the T-pipe inside of the chassis 9 and the pipes 17, 21 and 13 form a bypass or C-shaped channel or loop in which water flowing upward from the sewer pipe 10 flows into the C. As will be further described, a float valve is position in the vertical leg of the C loop and functions to detect a flow blockage, trigger an alarm and/or to trigger shut down of the washing machine. The loop functions to divert rising water resulting from a blockage downstream in the sewer pipe 10. In the event of a blockage and during operation of the washing machine, as the water rises, or backs-up, due to the blockage, that water flows into the loop 48 and ultimately to a conventional float switch that includes a float sensor 6, and internal solenoid 22. These components are positioned behind the J-box plate cover 5. As will be understood, the J-box provides a leak proof housing for the float switch, alarm and controls to preserve electrical integrity.

In a sewer blockage back flow situation, as water continues to rise in the T-pipe and loop, it will contact float sensor 6 to actuate the electric component 18 of the float switch and trip the solenoid 22. Once the electric component 18 is actuated, i.e., a circuit is closed, preferably an alarm, visual and/or audible is activated, and the washing machine is shut off. Once actuated, the back flow alarm and control sub-system transmits a signal via line 14, a line from the sensor to the main power, to a conventional Ground Fault Interrupter ("GFI"), shown connected to a standard LET lit plug 16 and GFI receptacle chord 15, which cuts off electric service to the washing machine or any other device connected to the electric outlet controlled by that specific GFI.

The preferred float switch is commercially available from Omega Engineering, Atlanta, Georgia, as its part # LVK-130 multi-level switch. The float switch is activated only when the sewer line is blocked. The waste water in the drain will rise because of the discharge flow from the operating washing machine, and/or appliance(s) or plumbing sources discharging water into the drain. When the rising water contacts the float switch, which normally is in the "closed" position, the float will rise until it causes the switch to be in the "open" position. In the open position, the float switch allows electric current to flow to the GGI receptacle which then automatically shorts or trips the GFI, thereby shutting off electrical power to the washing machine. With the washing machine disabled, the GFI can only be re-set when the drain blockage is cleared. The waste water then flows down into the sewer and the float on the float switch drops back to its closed position. The GFI reset button can be pressed to return electrical power to the washing machine. It is envisioned that other conventional back flow and power cut off sub-systems may be used in the present system. Also schematically shown at 33 are a capacitor, resistor, LED light and buzzer to protect the sensors from electrical surge.

With reference to the FIG. 2 End Elevation, a view of the interior of the preferred embodiment is shown, but in a view that is 90° from the view of the FIGS. 2 Front Elevation, standard washer to valve connection 20 is shown for the water service, and a sealed wire output port 19 is shown for the wire leading from the float valve to the GFI. A back flow prevention device, preferably a check valve is shown at 8, where it is positioned at an inlet of the chassis or housing 9. Water draining from the washing machine flows from right to left through the connection shown as universal drain attachment at 7. The back flow prevention device 8 is preferably a conventional check valve, pivoted at the top so that it is pushed open by the flow of water being pumped out of the washing machine, into the unit, and subsequently the drain. In FIG. 2 End Elevation the valve is shown in its open position, as if water was flowing into housing or chassis 9. The normal position of the valve is closed due to gravity. If a blockage occurs downstream of the valve 8, water backs up until it reaches the float valve, and keeps rising until it trips its solenoid and shuts off the washing machine as described above. Even though the washing machine or similar equipment such as a dishwasher would be isolated, water in the drain could continue to rise. In the event that backed-up water reaches the backflow prevention device or check valve 8, the pressure created by the rising water and gravity forces and keeps the diaphragm of the valve 8 closed. The one-way backflow valve 8 thereby prevents waste water and possible effluent from entering the washing machine. When the blockage is remedied and normal operating conditions resume, the washing machine or similar equipment can start working immediately with no time consumed by clean-up, maintenance, repair, replacement, or water damage due to flooding.

Figure 3:
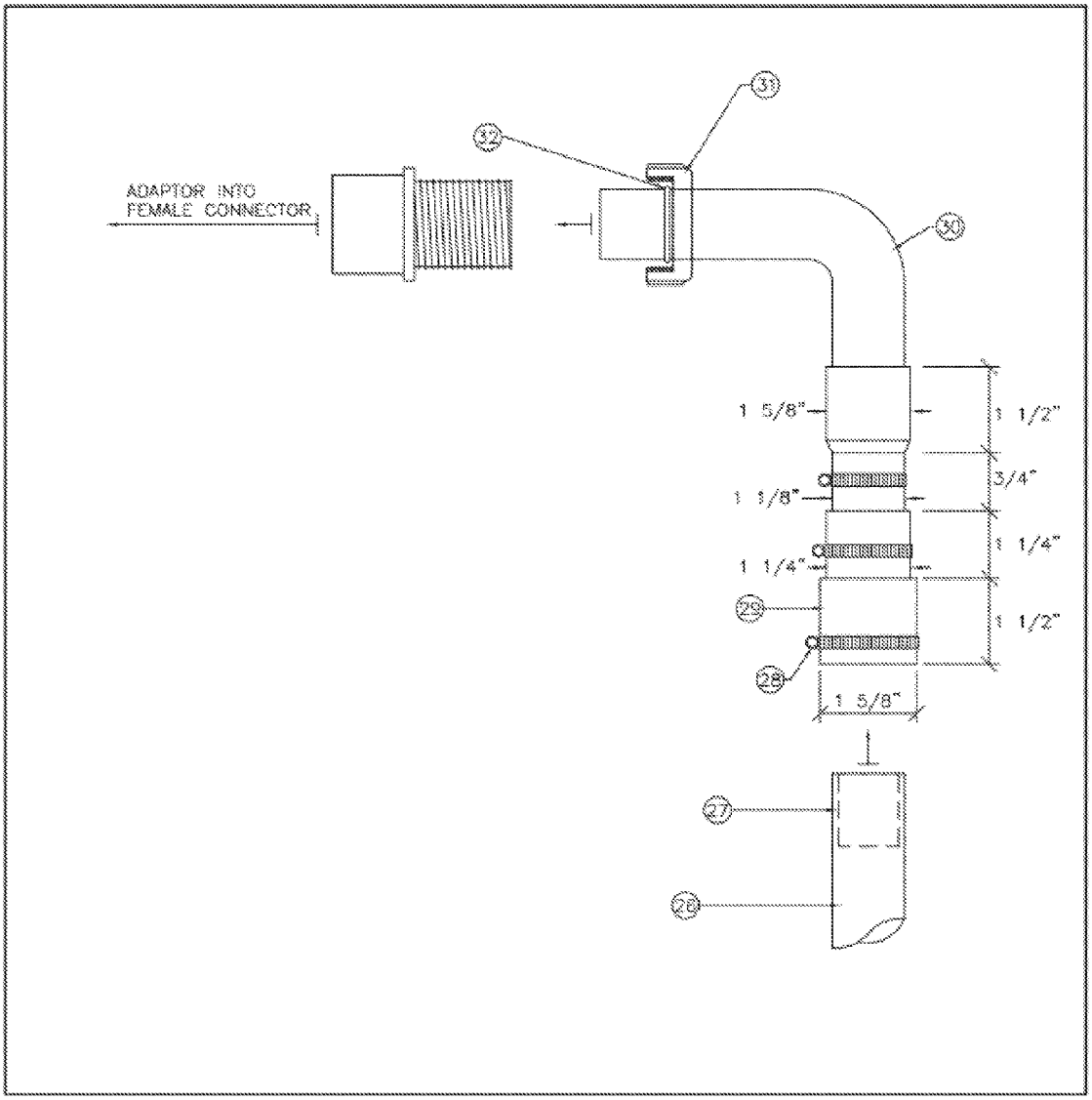
FIG. 3 is a side view of the universal connection sub-system of the FIG. 1 embodiment.

With reference to FIG. 3, the present system preferably includes a novel hose adaptor that has been modified from a commercially available adaptor from the Sealed Unit Parts Company Inc., (SUBCO), Allenwood, N.J., as its model SU-SSD6 drain hose. Whereas the conventional SUBCO adapter relies solely on friction to form the connection, the novel adapter described herein relies on a compression connection resulting from screwing the nut 31 onto the female end of the connector and to compress the ring 32, together which form an extremely tight connection or joint. The preferred adaptor includes an elbow or bent pipe 30 having a male end, a female connector (not numbered), an internal threaded nut 31 and a molded, in line or cone ring 32. The elbow or pipe 30 is preferably a 90-degree bend plastic pipe with one end adapted to be inserted into the female connector, which in turn position on the on the housing or chassis 9, at 7 on the FIG. 2. The male end of the adapter is inserted into the female connector, and the nut 31 is rotated to tighten and compress the ring 32 against the shoulder (not numbered) on the connector to form a compression joint and to prevent leaking and slipping.

At its upstream end the novel adaptor is connected to the washing machine drain hose 26 using an appropriately sized novel internal liner 27. The novel liner 27 is available in various sizes and is used to support the hose wall when compressed together with a connector. The preferred connecter is of the no-hub type of compression ring, which is tightened with a torque wrench to achieve a proper compression. Other types of compression connections may be used, so long as they provide for adequate compression to form a seal between the washing machine discharge and the adaptor. The novel adapter 30 is joined, preferably during manufacture, to a flexible, soft rubber telescoping adapter pipe having differing diameter collars. These collars are sized to receive drain hoses of many conventional washing machines. The upstream end of the novel adaptor, shown at the bottom right of FIG. WC-3 has been further modified to include tightening clamps attached to the soft rubber collars. These clamps are preferably movably affixed to the soft rubber telescopic tubes during manufacture. Also, a selection of different diameter rigid plastic inserts or "liners" are provided. For a specific installation, an appropriately sized liner, that is, a liner having an appropriately sized diameter is chosen and then inserted into the washing machine drain hose discharge end. The insert or liner supports and strengthens the discharge end of the hose. The discharge end of the hose is then inserted into the telescopic part of the novel adaptor until it reaches and enters one of the collars of a corresponding or similar diameter section of the rubber tubes until a snug fit is achieved. Pressure is applied on the tightening clamp, preferably by use of a torque wrench. As pressure is applied to the rubber collar by tightening the clamp, an equal and opposite force is exerted by the rigid insert or liner. This results in the rubber collar being compressed under relatively high pressure and onto the washing machine drain hose and the liner, making a very strong, water-tight and, for practical purposes, unbreakable joint.

With reference to FIG. 4 Electrical Surge Protection and 4 Perspective the electrical surge protection system is shown. The system includes a circuit in parallel with the line 14 from the float switch to the GFI receptacle, and includes, in series a capacitor, LED light and buzzer to provide an audible alarm. The LED light is preferably a red, flushed bezel, commercially available APEM part # QBF-1BXXR11OE. The buzzer is preferably Sonalert Malory part # SCE-120MA-3CTB, 120V. With reference to FIGS. 1 and 4 Perspective a preferred configuration on the cover plate 5 of the LEF light, wire port, and buzzer opening, or window is shown.

The preferred embodiment includes a one-piece mixing valve with a shut-off. The hot and cold water inlets preferably each have a two-foot length of ½" annealed copper pipe already soldered to the valve. The copper pipes are preferably annealed to make them more malleable. Due to the annealing process, the annealed water service pipes are relatively easily bent by hand for ease of installation and also to minimize potential damage to the system due to excessive force exerted during the installation process.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. An electro-mechanical system kit for preventing flooding caused by blockage in a drain line of a washing machine comprising:

a housing having a front side, a back side, a top side, a bottom side, a first side and a second side;

a hot water service valve, a cold water service valve and a mixing valve positioned in a recessed area of said front side of said housing;

a predetermined length of hot water service pipe operatively connected to said hot water service valve;

a predetermined length of cold water service pipe operatively connected to said cold water service valve a housing first orifice positioned in said first side of said housing and adapted for connection to said drain line;

a housing second orifice positioned in said top side of said housing and adapted for connection to a vent;

a housing third orifice positioned in said bottom side of said housing and adapted for connection to a sewer;

a housing fourth orifice, through which said hot water service pipe extends;

a housing fifth orifice, through which said cold water service pipe extends; and, a T-shaped pipe positioned inside of said housing and having a first leg and a second leg in fluid communication with each other;

said first leg of said T-shaped pipe having a first end and a second end;

said first end of said first leg terminating at an intermediate region of said second leg;

said second end of said first leg being threaded and extending outward from said housing;

said second leg of said T-shaped pipe having a vent end, having a sewer end and in fluid communication with said first leg at an intermediate position between said vent end and said sewer drain end;

said second leg of said T-shaped pipe having a C-shaped loop positioned intermediate said sewer end and said intermediate position;

a float actuated control switch positioned in said loop, in fluid communication with said pipe, adapted to activate an alarm and adapted to cut off power to said washing machine upon actuation of said float actuated control switch; and, a one-way flow control valve positioned in said first leg of said T-shaped pipe and adapted to prevent flow of liquid from said second leg of said T-shaped pipe through said first leg of said T-shaped pipe.

2. The kit of claim 1 further including an elbow pipe connector positioned between said washing machine drain and said second end of said first leg of said T-shaped pipe.

3. The kit of claim 2 further wherein said washing machine drain includes a hose having a predetermined internal diameter and kit includes an internal liner adapted to be placed inside of said hose.

4. The kit of claim 3 further including a clamp adapted for connecting said elbow pipe connector to said hose.

5. The kit of claim 1 further including a universal connector adapted to connect a washing machine drain line hose of any diameter of several predetermined diameters to said second end of said first leg of said T-shaped pipe.

6. A method of installing an electro-mechanical system for preventing flooding caused by blockage in a drain line of a washing machine comprising:

positioning in a studded wall at a height of about 39 inches to 96 inches above floor level a washing machine outlet box having hot and cold water service lines adapted for connection to a washing machine;

an inlet connection for washing machine discharge water and including a one-way flow check valve adapted to prevent water flow from said box to said drain line of said washing machine;

a sewer outlet connection; and, a vent outlet connection;

said inlet connection, said sewer outlet connection and said vent outlet connection operatively in communication with each other through a T-shaped pipe positioned internal to said box;

connecting said box sewer outlet connection to a sewer line;

connecting said box vent connection to a vent that is in fluid communication with atmosphere; and, connecting said hot water service and said cold water service lines to said washing machine.

7. An electro-mechanical system for preventing flooding caused by blockage in a sewer line that is in fluid communication with a washing machine drain line comprising:

a closed connection of between said drain line of washing machine and a horizontally oriented inlet to a T-connection pipe positioned in a washing machine outlet box;

the box having a bottom, a top, a first side and a second side;

a horizontal leg of the T-connection pipe lying substantially horizontal to the earth's surface at a first height, and a vertical leg of the T-connection pipe oriented vertically;

a one-way flow control valve positioned in said horizontal leg, adjacent said vertical leg and adapted to prevent fluid flow from said T-connection pipe to said drain line of said washing machine;

a first end of said vertical leg extending vertically upward above the first height and in fluid communication with a vent;

a second end of said vertical leg positioned at the bottom of said box and in fluid communication with a sewer;

a loop in fluid communication with the vertical leg of the T-connection pipe, and a float actuated switch positioned in the loop; and, said switch adapted and positioned to detect water in said loop, to activate upon water reached a predetermined height in said loop, and to cut off electric power to said washing machine when activated;

whereby cutting off power to said washing machine stops water from draining out of said washing machine and prevents flooding during blockage of said sewer line.

8. The system of claim 7 further comprising:

a connector positioned between the washing machine discharge hose and the T-connection pipe, said connector comprising:

a first end adapted to connect to and provide a tight, closed connection to said T-connection pipe;

a second end adapted to connect to the distal end of said washing machine drain line; and, positioned between said first end and said second end a plurality of connected, telescoping pipe sections, each having different diameters;

whereby said connector is adapted for connection with washing machine discharge lines of different diameters.

* * * * *